United States Patent [19]

Hida et al.

[11] Patent Number: 4,644,757

[45] Date of Patent: Feb. 24, 1987

[54] AUGER TYPE ICE-MAKING APPARATUS

[75] Inventors: Junichi Hida, Chiryu; Yasumitsu Tsukiyama, Toyoake; Yoshikazu Kito, Oobu; Susumu Tatematsu, Nagoya, all of Japan

[73] Assignee: Hoshizaki Electric Co., Ltd., Toyoake, Japan

[21] Appl. No.: 701,282

[22] Filed: Feb. 12, 1985

[51] Int. Cl.[4] ..... F25D 17/02; F25C 1/14

[52] U.S. Cl. ..... 62/188; 62/233; 62/303

[58] Field of Search ..... 62/233, 303, 354, 188; 134/94, 98

[56] References Cited

U.S. PATENT DOCUMENTS

| | | | |
|---|---|---|---|
| Re. 23,247 | 7/1950 | Rigby | 62/303 X |
| 2,013,501 | 9/1935 | Parker | 62/303 X |
| 2,015,566 | 9/1935 | Lowry | 134/98 X |
| 2,961,853 | 11/1960 | Cohrt | 62/303 X |
| 3,233,417 | 2/1966 | Soderberg | 62/233 |
| 3,323,320 | 6/1967 | Conz | 62/303 |
| 3,369,376 | 2/1968 | Kiovs | 62/303 X |
| 3,377,815 | 4/1968 | Soderberg | 62/233 X |
| 3,638,448 | 2/1972 | Raymen | 62/303 X |
| 4,363,223 | 12/1982 | Abbott | 62/303 |

*Primary Examiner*—William E. Wayner

*Attorney, Agent, or Firm*—Wenderoth, Lind & Ponack

[57] ABSTRACT

An auger type ice making apparatus adapted for effectively flushing and removing deepended water and precipitates in the water supply pipe and the freezing cylinder during ice making. The apparatus includes a water inlet having a supply valve for supplying ice-making water into the ice-making water tank, a water level switch in the tank, a generally cylindrical freezing cylinder communicating with the inside of the ice-making water tank, a screw shaft rotatably mounted within the freezing cylinder and having a screw edge, a freezing portion including a compressor for supplying a refrigerant to a freezing pipe coiled about the outer periphery of the freezing cylinder, a water supplying pipe between the ice making water tank and freezing cylinder, a water discharge valve in the freezing cylinder, and a control circuit construction including a cleaning timer for controlling the water supply valve and the water discharge valve the cleaning timer and the water level switch are operative to open the water discharge valve during the time that the water supply valve is closed, whereby the inside of said water supply pipe and the freezing cylinder is cleaned with an amount of the ice-making water within the operating range of the water level switch in the ice-making water tank.

4 Claims, 4 Drawing Figures

AUGER TYPE ICE-MAKING APPARATUS

BACKGROUND OF THE INVENTION

The present invention relates to an auger type ice-making machine and more particularly to an improvement in such an apparatus for effectively flushing the inside of the water supply pipe and the freezing cylinder during ice making to thereby remove the condensed water and precipitates from inside of the water supply pipe and the cylinder.

In the conventional apparatus, it has been the practice to discharge all of the ice-making water when a level of ice storage is detected or when the ice making operation is halted temporarily in order to clean the inside of the water supply pipe and the freezing cylinder. However, in the former case, that is, when the cleaning operation is performed upon detection of a level of ice storage, it may not always be possible to assure a daily cleaning operation as this depends on the size of the ice reservoir or the amount of the ice used. Thus, it is not always possible to remove the rapidly increasing amount of condensed water or precipitates.

In the latter case, that is, when the cleaning operation is performed after the operation of the ice-making portion is halted temporarily, the ice-making efficiency is lowered with increased energy loss.

SUMMARY OF THE INVENTION

It is an object of the present invention to provide a means whereby the aforementioned deficiencies may be removed effectively. Thus, the present invention provides an arrangement according to which the cleaning of the inside of the water supply pipe and the freezing cylinder may be effected without obstructing the ice making operation and with an amount of ice-making water within the operating range of a water level switch within the ice-making water tank when the cleaning timer and the water level switch are operative to open said water discharge valve during the time that the water supply valve is closed in the ice making operation. Above all, it provides an auger-type ice-making machine wherein the cleaning timer and the water level switch are operative to open said water discharge valve during the time that the water supply valve is closed in such a manner that the insides of said water supply pipe and the freezing cylinder are cleaned with an amount of ice-making water within the operating range of the water level switch in the ice-making water tank.

BRIEF DESCRIPTION OF THE DRAWINGS

In the drawings which illustrate an auger type ice-making apparatus according to the present invention.

DESCRIPTION OF THE PREFERRED EMBODIMENTS

Reference is made to an auger type ice making machine according to suitable embodiments of the present invention along with the drawings.

Figure 1:
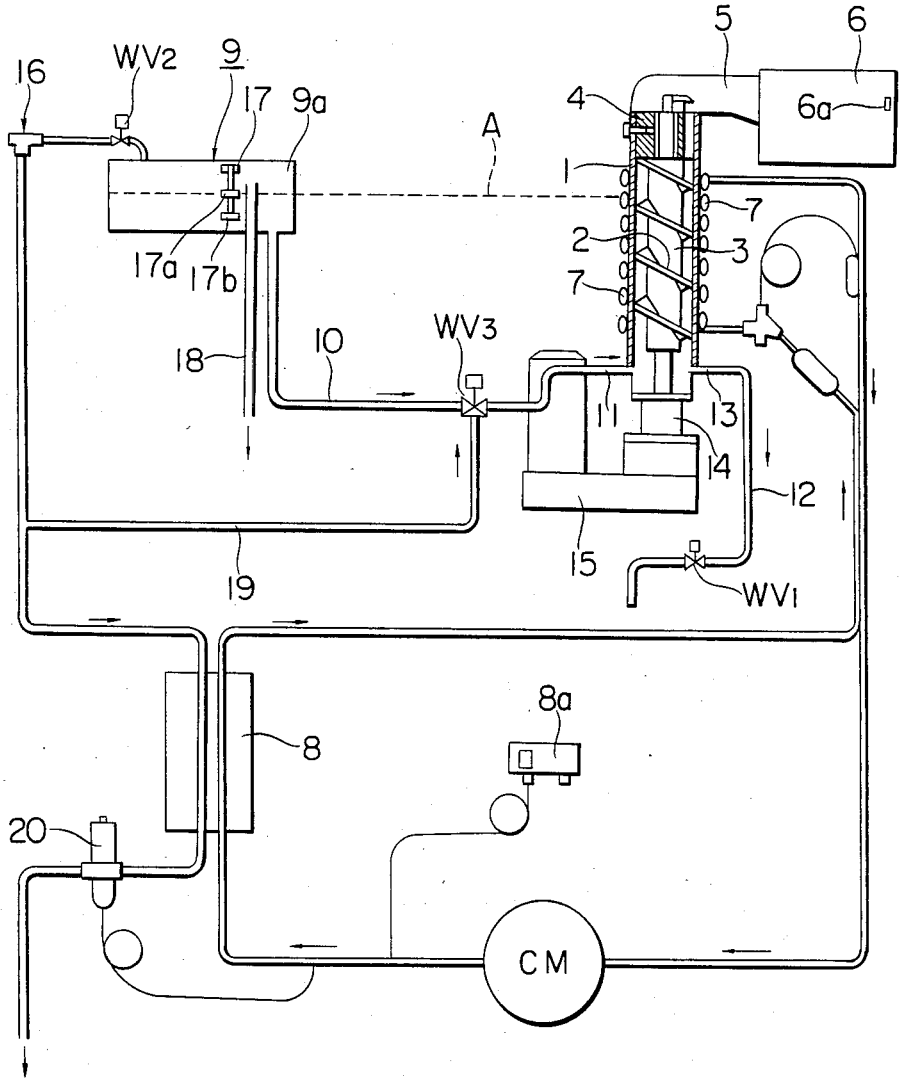
FIG. 1 is a diagrammatic view of the auger type ice-making apparatus provided with a water-cooled condenser according to the present invention.

Referring to FIG. 1 illustrating a first embodiment of the invention, the numeral 1 denotes a substantially cylindrical freezing cylinder. An auger shaft 3 having a screw edge 2 is mounted for rotation within the cylinder 1, and a compressing head 4 is mounted to the upper end of the screw shaft 3. An ice discharge duct 5 is attached to the upper end of the freezing cylinder 1. An ice reservoir 6 provided with an ice storage detecting switch 6a is annexed to the ice discharge duct 5.

A freezing pipe 7 connected to a compressor CM of the freezing unit and adapted for guiding the refrigerant is coiled around the periphery of the freezing cylinder 1. The refrigerant supplied from the compressor CM is supplied through a route indicated by the arrows by way of a pressure regulator 8a and a water-cooled condenser 8. The lower end portion of the freezing cylinder 1 is provided with a water inlet section 11 connected to a water inlet pipe 10 for transporting ice-making water contained in an ice-making water tank 9 and also is provided with a water discharge section 13 having a water discharge pipe 12 including a water discharge valve WV1. The auger shaft 3 is rotatably driven by a geared motor 15 attached to the lower end portion of the cylinder 1 via housing section 14. The ice-making water is supplied to the ice-making water tank 9 through a fresh water valve WV2 provided to a water inlet 16 connected with a water tap. The quantity of water in the tank 9 is detected by a first sensor **17*a* and a second sensor 17*b* of a water level switch 17 provided to an inner wall 9*a* of the tank 9. The ice-making water in the tank 9 is supplied to the inlet section 11 of the cylinder 1 through the water inlet pipe 10 and a three way type cleaning valve WV3 provided in the water inlet pipe 10. An overflow pipe 18 provided to the ice making water tank 9 and used for the overflow of ice-making water in the event that the quantity of water supplied from the valve WV2 exceeds the level of the first sensor 17*a* of the water level switch 17**.

The water inlet 16 is directly connected to one valve section of the cleaning valve WV3 through a water supply pipe 19. In the case of using a water-cooled type condenser, water can be discharged through an automatic water supply valve 20.

Figure 2:
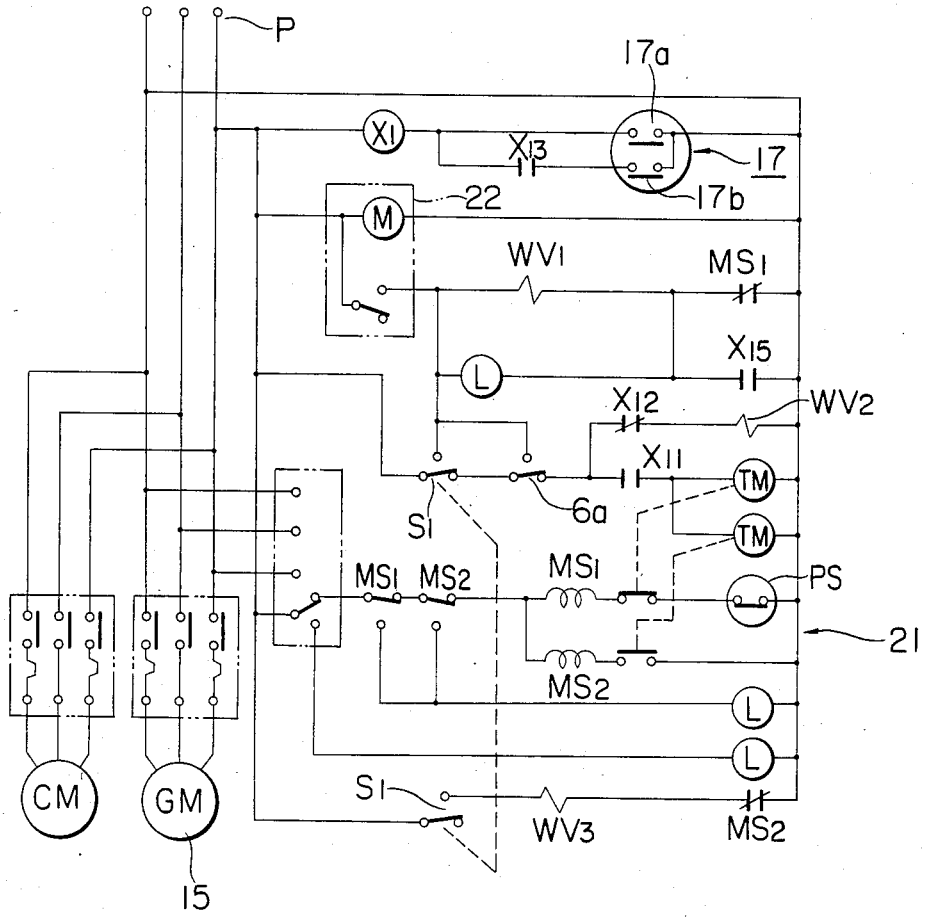
FIG. 2 is a circuit diagram showing a control circuit construction.

FIG. 2 shows a control circuit 21 of the auger type ice making machine according to the present invention. The water level switch 17 is connected to a power source P (three phase 200 Volts) through a relay $X_1$. A cleaning timer 22 connected at one end to the relay $X_1$ is connected to the water discharge valve WV1. The compressor CM, the geared motor 15 and a cleaning switch $S_1$ are also connected to the electrical source. The cleaning switch $S_1$ is provided with an ice storage detecting switch **6*a***, the supply water valve WV2 and the cleaning valve WV3.

Figure 3:
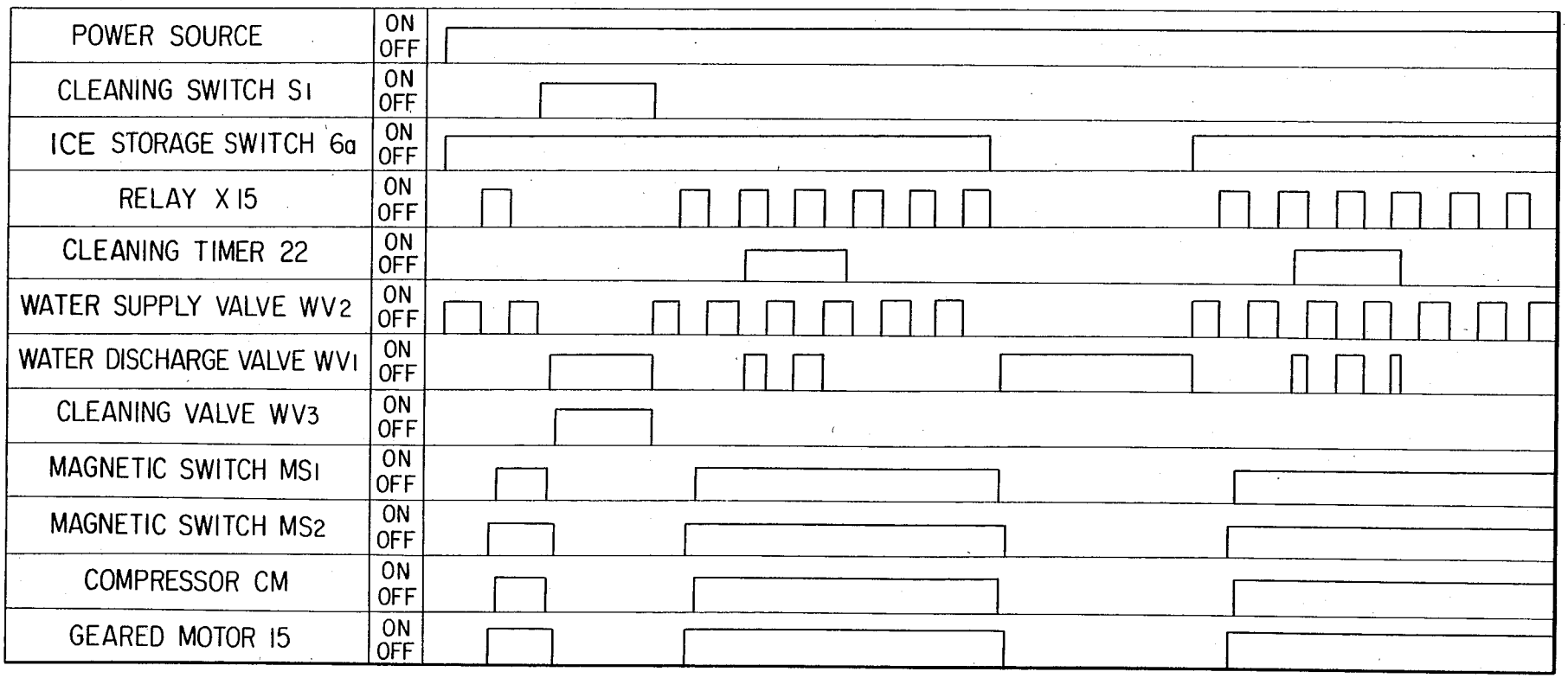
FIG. 3 is a timing chart diagram in connection with several operating elements.

Referring now to the operation of the above described auger type ice making apparatus of the present invention, the power source is turned ON for actuating the freezing section including the compressor CM, as well as the freezing cylinder 1 then being chilled, and the ice products formed in the freezing cylinder 1 are moved upward, as shown in FIG. 1, by the rotating screw edge 2, to be stored in the ice reservoir 6 through the ice discharge duct 5. According to our experiments, when ordinary tap water is used, the concentration of the various substances contained in the ice-making fresh water is elevated in about two hours and reaches a saturation point. Also, as the concentration of various substances becomes higher as when using well water or industrial use water, the time to saturation is shortened, and it becomes saturated because of the high densities. These substances are more likely to be precipitated and settled in the pipes 10, 19 and in the freezing cylinder 1 as the concentration of the substances in the ice-making fresh water increases. Thus, in order to remove these harmful substances, the cleaning timer 22 is operated for a certain time as shown by the timing chart of FIG. 3 and, when the water quantity in the tank 9 has reached an optimum level, that is, when the first sensor 17*a* of the water level sensor 17 is turned ON, the water supply valve WV2 is closed while the water discharge valve WV1 is opened only during the time that the valve WV2 is closed, whereby the substances settled in the water inlet pipe 10 and on the bottom of the freezing cylinder 1 are flushed by the ice-making water and removed. In this case, the quantity of water used for such cleaning is only that contained in the tank until the second sensor 17*b* of the water level switch 17 is activated. At this time, the water supply valve WV2 is opened by the operation of said second sensor 17*b*, the discharge valve WV1 is then closed and the fresh water is supplied until the first sensor 17*a* is operated, the ice making water having then reached the constant water level A. With the on/off one cycle time a of the water level switch 17, the operating time b of the cleaning timer 22 can be set so as to be ($b>2a$). In this case, the first cleaning operation is not performed during the first cycle because the operation of the timer 22 is started when the water level in the tank is the lowest level in which said water supply valve WV2 enables the supply of water, i.e., the level detected by the second sensor 17*b*. However, the cleaning is performed during the next cycle. The cleaning timer 22 is turned OFF after the lapse of a certain time so that the discharge valve WV1 is maintained in the open state to continue the ice-making operation.

As the ice products are stored in the ice reservoir 6 and the ice storage detecting switch 6a is turned ON, the water supply valve WV2 is closed and the water discharge valve WV1 is opened. More specifically, as is apparent from FIG. 2, when ice reservoir 6 is filled with ice, this state is detected by switch 6*a* and the switch 6*a* opens (FIG. 2 shows switch 6*a* in its closed state), automatically causing valve WV2 to close and valve WV1 to open so as to flush out with fresh water the substances settled in the water inlet pipe 10 and on the bottom of the freezing cylinder 1. The cleaning switch Sl is manually switched, then the cleaning valve WV3 is switched, whereby the tap water is directly supplied through the water inlet 16 and supply pipe 19 into the cylinder 1 and discharged through the opened discharge valve WV1 so that the cleaning operation may be achieved.

Figure 4:
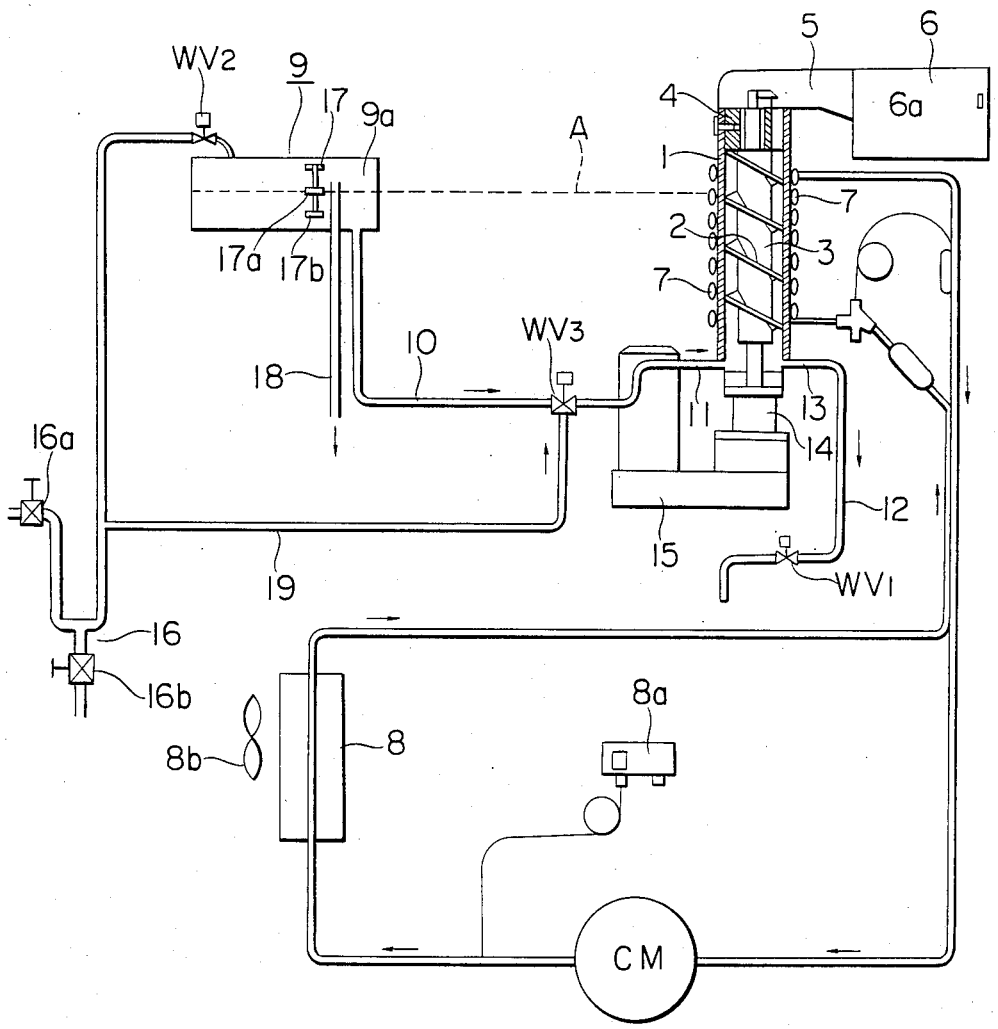
FIG. 4 is a diagrammatic view of the auger type ice-making apparatus provided with an air-cooled condenser according to the present invention.

FIG. 4 shows the overall structure of an auger type ice making apparatus in accordance with a second embodiment of the present invention, the condenser 8 of which is fitted with a fan 8*b* and thus cooled by air instead of by water as is the above described first embodiment of the present invention. The differences between the apparatus of the second embodiment and the first embodiment shown in FIG. 1 is that the water inlet 16 is a U-shaped tube having one end connected to a tap water cock 16*a* and a bottom portion connected to an anti-freeze cock 16*b* and thus the water inlet has no connection with the condenser 8. The operation and result of the auger type ice making apparatus shown in FIG. 4 are substantially similar to those of the preceding embodiment already explained with respect to FIG. 1.

According to the present invention an auger type ice making machine, is provided in which the water supply pipe and the freezing cylinder can be cleaned during the ice making operation without affecting the ice-making operation, whereby the ice-making capacity is not lowered, and scale accumulation in the freezing cylinder as well as the wear of the bearings or mechanical seals can be effectively prevented, thus providing for improved reliability and a smooth and effective ice-making operation for a long time.

What we claim is:

1. An auger type ice making apparatus comprising an ice-making water tank, a water inlet having a water supply valve for supplying ice-making into said ice-making water tank, means, including a water level switch in said tank, for opening and closing said water supply valve when the level of water in said tank is detected by said water level switch to be respectively at a lower level and a higher level above said lower level, a water inlet pipe, a generally cylindrical freezing cylinder communicating with the inside of the ice-making water tank through said water inlet pipe, a screw shaft mounted in the freezing cylinder and having a screw edge, a freezing portion including a compressor for supplying a refrigerant to a freezing pipe coiled around the outer periphery of the freezing cylinder, a water discharge valve for said freezing cylinder, and a control circuit means, including a cleaming timer, for controlling said water supply valve and the water discharge valve, wherein said cleaning timer and said water level switch are operatively controlled by said circuit control means to open said water discharge valve during the time that said water supply valve is closed by said opening and closing means, whereby the inside of said water inlet pipe and of said freezing cylinder are cleaned with an amount of the ice-making water in said water tank between said upper and lower levels in said ice-making water tank.

2. The auger type ice making apparatus as claimed in claim 1, further comprising an ice reservoir connected to said freezing cylinder and means, including an ice storage detecting switch in said ice reservoir, for respectively opening and closing said water supply valve and said discharge valve in response to detection of a level of ice stored in said reservoir by said ice storage detecting switch, whereby the ice making water in said water inlet pipe and said freezing cylinder are flushed out by flushing with ice-making water from said tank.

3. The auger-type ice making apparatus as claimed in claim 1, further comprising a three-way cleaning valve in said water inlet pipe and a water supply pipe connecting said water inlet and one valve section of said three-way cleaning valve and bypassing said tank, and wherein said control circuit means comprises means for concurrently opening said one valve section of said three-way cleaning valve and said water discharge valve for cleaning the inside of said water supply pipe and the freezing cylinder with water directly from said water inlet.

4. The auger type ice making apparatus as claimed in claim 3, wherein said control circuit means includes a cleaning switch electrically connected to said water supply valve, said water discharge valve and said cleaning valve, said cleaning switch being actuatable to open said water discharge valve and said one valve section of said three-way cleaning valve and close said water supply valve, to enable the cleaning of the inside of the water supply pipe and the freezing cylinder with water directly from said water inlet.

* * * * *